United States Patent [19]

Reinehr et al.

[11] Patent Number: 4,650,624

[45] Date of Patent: Mar. 17, 1987

[54] PROCESS FOR THE PRODUCTION OF FILAMENTS AND FIBRES FROM ACRYLONITRILE POLYMERS

[75] Inventors: Ulrich Reinehr; Toni Herbertz, both of Dormagen, Fed. Rep. of Germany

[73] Assignee: Bayer Aktiengesellschaft, Leverkusen, Fed. Rep. of Germany

[21] Appl. No.: 730,394

[22] Filed: May 3, 1985

[30] Foreign Application Priority Data

May 22, 1984 [DE] Fed. Rep. of Germany ..... 3418943

[51] Int. Cl.[4] ..... D01D 5/22

[52] U.S. Cl. ..... 264/143; 264/151; 264/168; 264/206; 264/210.2; 264/210.8; 264/211; 264/234; 264/345

[58] Field of Search ..... 264/169, 211, 182, 143, 264/151, 168, 206, 210.2, 210.8, 234, 345; 8/597, 534, 551, 927, 538

[56] References Cited

U.S. PATENT DOCUMENTS

| | | | |
|---|---|---|---|
| 2,648,592 | 8/1953 | Stanton et al. | 264/182 |
| 3,415,611 | 12/1968 | Callahan et al. | 264/182 |
| 4,457,884 | 7/1984 | Reinehr et al. | 264/168 |

*Primary Examiner*—Donald Czaja
*Assistant Examiner*—Hubert C. Lorin
*Attorney, Agent, or Firm*—Sprung Horn Kramer & Woods

[57] ABSTRACT

Damage to the natural tone of acrylic fibres, produced according to a continuous dry spinning process, can be avoided if from 0.025 to 0.2% by weight of ethylene diamine tetra-acetic acid, based on the fibrous solids material, is added to the spinning solution.

3 Claims, No Drawings

PROCESS FOR THE PRODUCTION OF FILAMENTS AND FIBRES FROM ACRYLONITRILE POLYMERS

This invention relates to a continuous dry spinning process for the production of filaments and fibres from acrylonitrile polymers, which filaments and fibres have an improved degree of whiteness.

A continuous dry spinning process is known from EP-OS 98 477, in which the spinning bulk leaving the spinning shaft has a residual solvent content of less than 40% by weight, in particular from 2 to 10% by weight, based on the dry weight of the fibrous material. Such spinning bulk is prepared directly inside, or just below the spinning shaft, is then stretched, crimped, fixed and matured as continuous cable or converted into staple fibres by cutting, without the cable contacting a solvent-extraction liquid. Such polyacrylonitrile spinning filaments with a low solvent content can be produced by using high, shaft and air, temperatures, optionally in conjunction with large quantities of air. A further possibility for producing polyacrylonitrile spinning filaments with a low solvent content, consists of extending the residence time of the spinning filaments in the spinning shafts for the purpose of steaming out the spinning solvent. In this case, either correspondingly long spinning shafts are used, or the spinning drawing speed is reduced in the spinning shaft. In the case of the continuous production of polyacrylonitrile filaments with a low solvent content, by the process mentioned at the outset, it has now been found that there is pronounced yellowing of the spinning filaments with high temperature stress in the spinning shaft, at a spinning drawing speed of less than 250 m/min.

An object of the present invention is to produce acrylic fibres with an improved degree of whiteness by the continuous dry spinning process.

It has now surprisingly been found that the spinning fibres can have a very good degree of whiteness if substantial heat stress is exerted in the spinning shaft in the production of such spinning filaments, if from 0.025 to 0.2% by weight of ethylene diamine tetraacetic acid (EDTA), based on polyacrylonitrile solids material, is added to the spinning solution. Preferably from 0.05 to 0.1% by weight of EDTA are added.

The dissolution of EDTA in the spinning solution can be facilitated by adjusting the spinning solution, to a pH of less than 2.5, for example by means of sulphuric acid.

There have hitherto been many attempts made to bring about an improvement in the degree of whiteness of acrylic fibres using additives. In the process described at the outset, these additives had no effect compared with EDTA, as the determination of the degree of whiteness according to Berger showed (A. Berger, Weissgradformeln und ihre praktische Bedeutung; die Farbe 8, (1959) 4/6, pages 187 to 202). Thus, the additives specified in the relevant literature: citric acid, succinic acid, oxalic acid and maleic acid, maleic acid anhydride and succinic anhydride, various phosphoric carboxylic acids and mercaptans, such as mercaptobenzimidazole, thio compounds, such as thioglycol and thiosemicarbazide, both on their own and in combinations in a quantity of up to 1% by weight, based on polymer solids material, resulted in only gradual improvements in the degree of whiteness, without, however, achieving the effect of EDTA.

EDTA is preferably added to the spinning solvent before the spinning solution is produced, by introducing the polymer and dissolving by heating. Other types of metering are likewise possible and effective.

The improvement in the degree of whiteness of acrylic fibres by the continuous dry spinning process described, by addition of EDTA, could be confirmed on fibres which were produced from acrylonitrile homopolymers, as well as on fibres which were spun from a wide variety of acrylonitrile copolymers.

MEASUREMENT OF THE DEGREE OF WHITENESS 3 g of carded fibres are placed in sample dishes and the standard colour values X, Y and Z in the CIE-system are determined with a 3-filter photometer, model Hunterlab D 25-9. The degree of whiteness according to Berger, (W), is calculated from the standard colour values as follows:

$$X=0.783\ R_x+0.198\ R_z$$

$$Y=R_y$$

$$Z=1.182R_z$$

$$W=R_y=3\ (R_z-R_x)$$

EXAMPLE 1

10 kg of dimethyl formamide are heated for 20 minutes with stirring to 150° C., in a tank with 300 g of EDTA, and are then cooled to room temperature. The solutions is added with stirring to another tank, which contains 690 kg of dimethyl formamide at room temperature, and is mixed with 300 kg of an acrylonitrile copolymer consisting of 93.6% by weight of acrylonitrile, 5.7% by weight of methyl acrylate, and 0.7% by weight of sodium methallylsulphonate, with a K-value of 81 (Fikentscher, Cellulose-Chemie 13, 1932, page 58). The suspension, which contains 0.1% by weight of EDTA, based on polymer solids material content, is pumped via a gear pump into a spinning tank provided with a stirring device. The suspension is then heated in a double-walled tube with steam under a pressure of 4.0 bars. The residence time in the tube is 5 minutes. The spinning solution, which has a temperature of 138° C. at the outlet of the tube, after leaving the heating apparatus is cooled to 90° C., is filtered and passed directly to a spinning apparatus with 20 spinning shafts. The spinning solution is dry spun from 1264-orifice nozzles, having a nozzle orifice diameter of 0.2 mm, at a drawing speed of 50 m/min. The residence time of the spinning filaments in the spinning shafts is 5 seconds. The shaft temperature is 210° C. and the air temperature is 400° C. The quantity of air passed through is 40 $m^3$/h for each shaft.

The spinning bulk with a total titre of 310'000 dtex, which still has a residual solvent content of 6.3% by weight, based on the solids content, is wetted immediately before leaving the spinning shafts with an 80° to 90° C. warm, aqueous, oil-containing, anti-static preparation, such that the oil content of the filaments is 0.18% by weight, the anti-static agent content is 0.06% by weight and the moisture content is 0.9% by weight, based on the solids material content. The warm cable is then passed over a series of 7 rollers which have been steam heated to 160° C., the cable reaching a tow temperature of 115° C., measured with the radiation thermometer KT 15 (manufactured by Heimann GmbH, Wiesbaden FRG). The cable is stretched by 500%, a series of 7 stretching devices with coolable rollers serving as a second clamping point. The tow temperature is about 65° C. after the stretching process. The cable is then immediately crimped in a compression chamber and relaxed with superheated steam in a perforated belt steamer, which is directly connected to the compression chamber. The residence time in the steamer is about 5 minutes. The cable, ready-shrunk to completion, is then cut into staple fibres, 60 mm in length, blasted and supplied to a packing press. The acrylic fibres produced in this manner in a continuous process have an individual fibre titre of 3.3 dtex. The fibre strength is 3.4 cN/dtex and the elongation is 38%. The degree of whiteness of the fibres according to Berger, determined with the three-filter photometer, model Hunterlab D 25-9, is 53.7.

In the following Table 1, the corresponding degree of whiteness of the fibres according to Berger is given for spinning bulk with the same total titre of 310'000 dtex at different spinning drawing speeds, with differing proportions of EDTA, as well as varying DMF-contents. The differing DMF-contents in the spinning bulk result from differing residence times in the spinning shaft, under otherwise identical conditions. As can be seen from Table 1, no degree of whiteness over 50 can be achieved at a spinning drawing speed of up to 250 m/min, without addition of stabilizers, by the continuous dry spinning process for the production of acrylic fibres. At a drawing speed of 300 m/min, the residence time (about 0.8 seconds) in the spinning shafts is already so short, that there is no longer any substantial damage to the natural tone, however the DMF-content in the spinning bulk then increases. In this case, the addition of stabilizers brings about only a gradual improvement. Table 1 shows, moreover, that an addition of 0.025% by weight of EDTA, based on the polymer solids content, is generally sufficient to increase the degree of whiteness of the fibre to values of over 50. An addition of 0.05% by weight is particularly preferred. A further increase in the quantity of stabilizer produces only an insubstantial improvement in the natural tone.

TABLE 1

| No. | Spinning drawing speed m/min | Addition of EDTA % by weight | DMF content of spinning bulk % | Degree of whiteness of fibre (Berger) |
|---|---|---|---|---|
| 1 | 50 | — | 6.3 | 31.0 |
| 2 | 75 | — | 7.6 | 38.4 |
| 3 | 75 | 0.025 | 7.6 | 52.8 |
| 4 | 75 | 0.05 | 7.6 | 56.9 |
| 5 | 75 | 0.1 | 7.6 | 57.4 |
| 6 | 75 | 0.2 | 7.6 | 57.7 |
| 7 | 100 | — | 7.9 | 45.6 |
| 8 | 100 | 0.05 | 7.9 | 58.7 |
| 9 | 250 | — | 16.2 | 48.3 |
| 10 | 250 | 0.05 | 16.2 | 62.2 |
| 11 | 300 | — | 21.7 | 58.9 |
| 12 | 300 | 0.05 | 21.7 | 60.3 |

EXAMPLE 2

A spinning solution consisting of 630 kg of dimethyl formamide and 260 kg of an acrylonitrile copolymer according to Example 1, is produced according to Example 1 and spun from 1264-orifice nozzles. In a separate stirring tank, 300 g of EDTA are dissolved, with stirring at 120° C., in 70 kg of DMF and are cooled to room temperature. 30 kg of the above-mentioned acrylonitrile copolymer are then added and dissolved as described in Example 1, cooled to 90° C. and metered, before filtration via a gear pump, into the side stream of the main spinning solution, such that the proportion of EDTA is again 0.05% by weight, based on the polymer solids material. Before filtration, both solutions are passed through a tube with mixing combs for more thorough mixing. Further after-treatment is carried out analogously to Example 1. The fibres again have an individual fibre titre of 3.3 dtex. The degree of whiteness of the fibres according to Berger is 51.6.

EXAMPLE 3

The spinning solution, and a starting mixture which contains EDTA as stabilizer, is produced according to Example 2. However, the starting mixture is metered into the side stream, after filtration of the main spinning solution, immediately in front of a tube fitted with mixing combs for improved distribution of the stabilizer, and before the spinning solution branches off to the individual spinning shafts. Further aftertreatment to produce fibres with an individual fibre titre of 3.3 dtex is again carried out according to Example 1. The degree of whiteness of the fibres according to Berger is 53.1.

The following Table 2 (page 11/12), discloses the degree of whiteness of the fibres which have been produced from different acrylonitrile polymers by the continuous dry spinning process. Spinning is carried out, in each case, with or without 0.05% by weight of EDTA as stabilizer according to Example 1, using 380-orifice nozzles at a drawing speed of 100 m/min. The residence time of the spinning filaments in the spinning shafts is about 2.5 seconds. The shaft and air temperatures, as well as the quantity of air passed through each spinning shaft, correspond to those of Example 1. The different spinning bulk with a total titre of 81'400 dtex, which still has the residual solvent contents given in Table 2, is, as described in more detail in Example 1, prepared, stretched 4 times, crimped, fixed and cut into staple fibres, 60 mm in length. The acrylic fibres produced in this manner have a fibre titre of 3.3 dtex, a fibre strength of 2.7 cN/dtex and an elongation of 44%.

As can be seen from Table 2, clear improvements in the degree of whiteness, which, however, vary according to the modification of the polymer, are achieved by using EDTA as stabilizer. Fibres consisting of acid modified copolymers have a degree of whiteness, according to Berger, of more than 50. Fibres consisting of base-modified copolymers, as well as of acrylonitrile homopolymers have a degree of whiteness of more than 40, while halogen-containing modacrylic fibres, produced with little solvent by the process according to the invention, have a degree of whiteness of more than 30.

EXAMPLE 4

(Comparative Example)

Table 3 (page 13) gives the degree of whiteness of fibres comprising the polymer of Example 1, with other stabilizers.

The mixture is spun in the spinning shaft through a 380-orifice nozzle at a drawing speed of 100 m/min and with a residence time of 2.5 seconds. The remaining conditions correspond to Example 1. The spinning bulk with a total titre of 81400 dtex is prepared, stretched 4 times, crimped, fixed and cut into staple fibres according to Example 1.

Table 3 shows the only EDTA produces a significant improvement in the degree of whiteness.

TABLE 3-continued

| No | Stabilizer | Addition % by weight | Degree of whiteness of fibre (Berger) |
|---|---|---|---|
| 11 | mercaptobenzimidazole | 0.5 | 49.2 |
| 12 | thioglycol | 1.0 | 46.1 |
| 13 | thiosemicarbazide | 1.0 | 45.0 |
| 14 | nitrilotriacetic acid | 0.1 | 49.8 |
| 15 | mercaptobenzimidazole | 0.05 | 45.5 |
| | citric acid | 0.05 | |
| 16 | mercaptobenzimizole | 0.05 | 46.9 |
| | maleic anhydride | 0.05 | |
| 17 | mercaptobenzimidazole | 0.05 | 56.1 |
| | EDTA | 0.05 | |
| 18 | EDTA | 0.05 | 56.4 |

TABLE 2

| No. | Polymer composition (% by weight) | Concentration of the spinning solution % by weight | Addition of EDTA % by weight | DMF content of spinning bulk % by weight | Degree of whiteness of fibre (Berger) |
|---|---|---|---|---|---|
| 1 | acrylonitrile homopolymer | 25 | — | 16.6 | 36.1 |
| 2 | acrylonitrile homopolymer | 25 | 0.05 | 16.6 | 45.3 |
| 3 | 90 ACN/5,5 methyl acrylate 4,5 dimethyl aminoethyl methacrylate | 30 | — | 10.3 | 35.5 |
| 4 | 90 ACN/5,5 methyl acrylate 4,5 dimethyl aminoethyl methacrylate | 30 | 0.05 | 10.3 | 44.7 |
| 5 | 91 ACN/5,6 methyl acrylate 3,4 sodium methallyl sulphonate | 30 | — | 9.6 | 42.9 |
| 6 | 91 ACN/5,6 methyl acrylate 3,4 sodium methallyl sulphonate | 30 | 0.05 | 9.6 | 53.6 |
| 7 | 59 ACN/37,5 vinylidene chloride/3,5 sodium methallyl sulphonate | 37.5 | — | 8.3 | 22.3 |
| 8 | 59 ACN/37,5 vinylidene chloride/3,5 sodium methallyl sulphonate | 37.5 | 0.05 | 8.3 | 33.0 |
| 9 | 90 ACN/5 acrylic amide/5 N—methoxymethyl acrylic amide | 30 | — | 11.2 | 37.8 |
| 10 | 90 ACN/5 acrylic amide/5 N—methoxymethyl acrylic amide | 30 | 0.05 | 11.2 | 46.3 |

TABLE 3

| No | Stabilizer | Addition % by weight | Degree of whiteness of fibre (Berger) |
|---|---|---|---|
| 1 | without | — | 43.3 |
| 2 | citric acid | 0.5 | 39.2 |
| 3 | citric acid | 1.0 | 40.1 |
| 4 | succinic acid | 0.5 | 40.7 |
| 5 | succinic acid | 1.0 | 40.9 |
| 6 | oxalic acid | 1.0 | 43.6 |
| 7 | maleic acid | 1.0 | 44.2 |
| 8 | maleic anhydride | 1.0 | 45.1 |
| 9 | succinic anhydride | 1.0 | 44.7 |
| 10 | mercaptobenzimidazole | 0.1 | 48.3 |

We claim:

1. In the production of filaments and fibres with an improved degree of whiteness from acrylonitrile polymers containing at least 40% by weight of acrylonitrile units by dry spinning a spinning solution of the polymers in a spinning shaft, evaporating at least some of the spinning solvent in the spinning shaft, preparing, stretching, crimping, fixing and optionally cutting, in a continuous operation, the improvement which comprises including in the spinning solution as stabiliser from 0.025 to 0.2% by weight of ethylene diamine tetra-acetic acid, based on polymer solids.

2. A process according to claim 1, wherein from 0.05 to 0.1% by weight of ethylene diamine tetra-acetic acid is added.

3. A process according to claim 1, wherein the ethylene diamine tetra-acetic acid is dissolved in the spinning solvent or in the spinning solution at a pH of less than 2.5.

* * * * *